United States Patent [19]

Greanias et al.

[11] Patent Number: 4,862,945

[45] Date of Patent: Sep. 5, 1989

[54] VACUUM COUNTERGRAVITY CASTING APPARATUS AND METHOD WITH BACKFLOW VALVE

[75] Inventors: Anthony C. Greanias; James B. Mercer, both of Saginaw, Mich.

[73] Assignee: General Motors Corporation, Detroit, Mich.

[21] Appl. No.: 238,203

[22] Filed: Aug. 30, 1988

[51] Int. Cl.[4] ..... B22D 18/06

[52] U.S. Cl. ..... 164/63; 164/255; 164/337

[58] Field of Search ..... 164/63, 255, 256, 337

[56] References Cited

U.S. PATENT DOCUMENTS

| | | | |
|---|---|---|---|
| 2,908,054 | 10/1959 | Wilkins | 164/255 |
| 3,774,668 | 11/1973 | Heimgartner | 164/255 |
| 4,340,108 | 7/1982 | Chandley et al. | 164/63 |
| 4,589,466 | 5/1986 | Chandley et al. | 164/119 |
| 4,606,396 | 8/1986 | Chandley et al. | 164/255 |

FOREIGN PATENT DOCUMENTS

| | | | |
|---|---|---|---|
| 6502829 | 9/1965 | Netherlands | 164/337 |
| 7002655 | 8/1970 | Netherlands | 164/337 |
| 1042881 | 9/1983 | U.S.S.R. | 164/337 |

*Primary Examiner*—Nicholas P. Godici
*Assistant Examiner*—J. Reed Batten, Jr.
*Attorney, Agent, or Firm*—Reising, Ethington, Barnard, Perry & Milton

[57] ABSTRACT

An apparatus for the vacuum, countergravity casting of molten metal includes a bottom drag member and a casting mold member thereon engaged together at a parting plane. A valve member is disposed adjacent the parting plane in an ingate to a mold cavity formed at least in part in the casting mold member and is movable between a valve seat on the bottom drag member and a stop surface on the casting mold member to permit filling of the mold cavity in countergravity manner from an underlying molten metal pool when the bottom drag member is immersed therein and to prevent backflow of the molten metal from the mold cavity when the bottom drag member is withdrawn from the pool after mold filling and before solidification of the molten metal in the mold cavity.

15 Claims, 1 Drawing Sheet

VACUUM COUNTERGRAVITY CASTING APPARATUS AND METHOD WITH BACKFLOW VALVE

FIELD OF THE INVENTION

This invention relates to the vacuum-induced, countergravity casting of molten metal and, more particularly, to molten metal valve means disposed in the ingate of a casting apparatus to permit withdrawal of the apparatus from an underlying molten metal supply pool even though the molten metal cast into the apparatus remains molten and unsolidified whereby immersion time of the apparatus in the pool is reduced.

BACKGROUND OF THE INVENTION

A vacuum countergravity casting process using a gas permeable mold is described in such prior patents as the Chandley et al U.S. Pat. Nos., 4,340,108 issued July 20, 1982 and 4,606,396 issued Aug. 19, 1986. That countergravity casting process involves providing a mold having an expendable porous, gas permeable upper mold member (cope) and an expendable lower mold member (drag) engaged together at a parting plane, sealing the bottom lip of a peripheral wall of a vacuum chamber to the mold such that the vacuum chamber confronts the gas permeable upper mold member, submerging the bottom side of the lower mold member in an underlying molten metal pool and evacuating the chamber to draw the molten metal through one or more ingate passages in the lower mold member and into one or more mold cavities formed between the upper and lower mold members.

Typically, this process fills the mold cavities with molten metal in a very short time (approximately 2–3 seconds). However, the mold must remain submerged in the molten metal pool until the molten metal in the ingate passages of the lower mold member freezes off (solidifies). For example, the mold typically must remain submerged in the molten metal pool on the order of 15 to 50 seconds after mold filling to freeze (solidify) the molten metal in the ingate passages. In the event the mold is raised out of the molten metal pool prior to freezing of the molten metal in the ingate passages, the molten metal in the ingate passages as well as in the mold cavities can flow downwardly out of the mold and result in a defective casting which must be scrapped.

Moreover, such expendable counterqravity casting molds are complex in that in addition to the mold cavities themselves, they also require vacuum chamber sealing surfaces thereon as well as means for securing the molds to the vacuum chamber. They are typically relatively expensive (e.g., compared to green sand molds) in that they require more expensive materials (e.g., resin-sand mixtures and curing agents therefor).

A technique for permitting use of less complex molds made from lower quantities of, and perchance cheaper, mold materials is illustrated in copending U.S. patent application Ser. No. 238,724 entitled Countergravity Casting Apparatus And Process For Casting Thin-Walled Parts wherein one or more casting molds are positioned on a reuseable bottom drag slab that is immersed in the molten metal supply pool to draw molten metal upwardly through an ingate in the drag slab and into the casting mold(s) thereon. Although the ingate of the drag slab may include a molten metal filter therein for removing inclusion-forming impurities from the molten metal as it is drawn upwardly into the casting molds, there is no means in the ingate to prevent back flow of unsolidified metal from the casting mold in the event the drag slab is removed from the pool too soon; i.e., before the molten metal in the ingate and mold cavity solidifies.

It is an object of the present invention to provide an improved, cost effective casting apparatus and method for the vacuum-induced, countergravity casting of molten metal characterized by significantly reduced immersion times of a bottom drag member of the apparatus in the underlying molten metal supply pool as a result of valve means being positioned in the ingate of the drag member to preclude back flow of molten metal when the drag member is removed from the pool prior to solidification of the molten metal cast into the apparatus. It is another object of the present invention to position the valve means in the ingate adjacent a parting plane defined between the bottom drag member and a casting mold member disposed on the bottom drag member to facilitate manufacture and assembly and such as to permit the valve means (i.e., a valve member) to move between a valve seat on the bottom drag member and a stop surface on the casting mold member. These and other objects and advantages of the present invention will become more readily apparent from the description thereof which follows.

SUMMARY OF THE INVENTION

The invention contemplates a casting apparatus for the vacuum-induced, countergravity casting of molten metal wherein the casting apparatus comprises (a) a bottom drag member having a bottom side adapted for immersion in an underlying molten metal pool and a top side, (b) a casting mold member on the top side of the bottom drag member and having a bottom side engaged on the top side of the bottom drag member to form a parting plane therebetween and a mold cavity formed at least in part therein, (c) ingate means disposed between the bottom side of the bottom drag member and the mold cavity for supplying the molten metal to the mold cavity, and (d) valve means disposed in the ingate means adjacent the parting plane and including a valve member movable between the bottom drag member and the casting mold member thereon to permit molten metal to flow upwardly through the ingate means into the mold cavity when the bottom side of the bottom drag member is immersed in the pool with the mold cavity evacuated and to prevent back flow of the molten metal downwardly from the mold cavity through the ingate means when the bottom side is extracted from the pool after mold filling and before the molten metal is solidified in the mold cavity.

In one embodiment of the invention, the bottom drag member may comprise a reuseable bottom drag slab and the casting mold member thereon may comprise a casting mold drag supported on the top side of the drag slab and having a mating casting mold cope disposed thereon. The valve means is disposed in the ingate adjacent the parting plane for movement of the valve member between the bottom drag slab and the mold drag thereon. In another embodiment of the invention, the bottom drag member may comprise a casting mold drag while the mold member thereon may comprise the mating mold cope engaged on the drag at a mold parting plane. The valve means is disposed in the ingate adjacent the mold parting plane for movement of the valve member between the mold drag and the mold cope.

In a preferred embodiment of the invention, the valve means also includes a valve seat on the bottom drag member and a stop surface on the casting mold member overlying the valve seat and the valve member. The valve member is movable between the valve seat and the stop surface.

In another preferred embodiment of the invention, the ingate means comprises a lower ingate passage in the bottom drag member and an upper ingate passage in the casting mold member. The lower and upper ingate passages are relatively axially offset in such a manner to form the stop surface on the bottom side of the mold member.

The invention also contemplates a method for the vacuum-induced, countergravity casting of molten metal in a casting apparatus having a bottom drag member and a casting mold member disposed on the bottom drag member and forming a parting plane therebetween, comprising (a) relatively moving the apparatus and an underlying molten metal pool to immerse a bottom side of the bottom drag member in the pool, (b) evacuating a mold cavity formed at least in part in the casting mold member when the bottom side is immersed in the pool to draw the molten metal upwardly through ingate means between the bottom side and the mold cavity, including moving a valve member disposed in the ingate means adjacent the parting plane between the bottom drag member and the casting mold member thereon in a valve open manner for supplying the molten metal to the mold cavity through the ingate means, and (c) withdrawing the bottom side from the pool after the mold cavity is filled with the molten metal and before the molten metal solidifies in the mold cavity, including moving the valve member in the ingate means between the bottom drag member and the casting mold member thereon in a valve closed manner for preventing back flow of the molten metal downwardly from the mold cavity through the ingate means.

BRIEF DESCRIPTION OF THE DRAWINGS

The invention may be understood better when considered in light of the following detailed description of certain specific embodiments thereof which are given hereafter in conjunction with the following drawings.

DETAILED DESCRIPTION OF THE INVENTION

Figure 1:
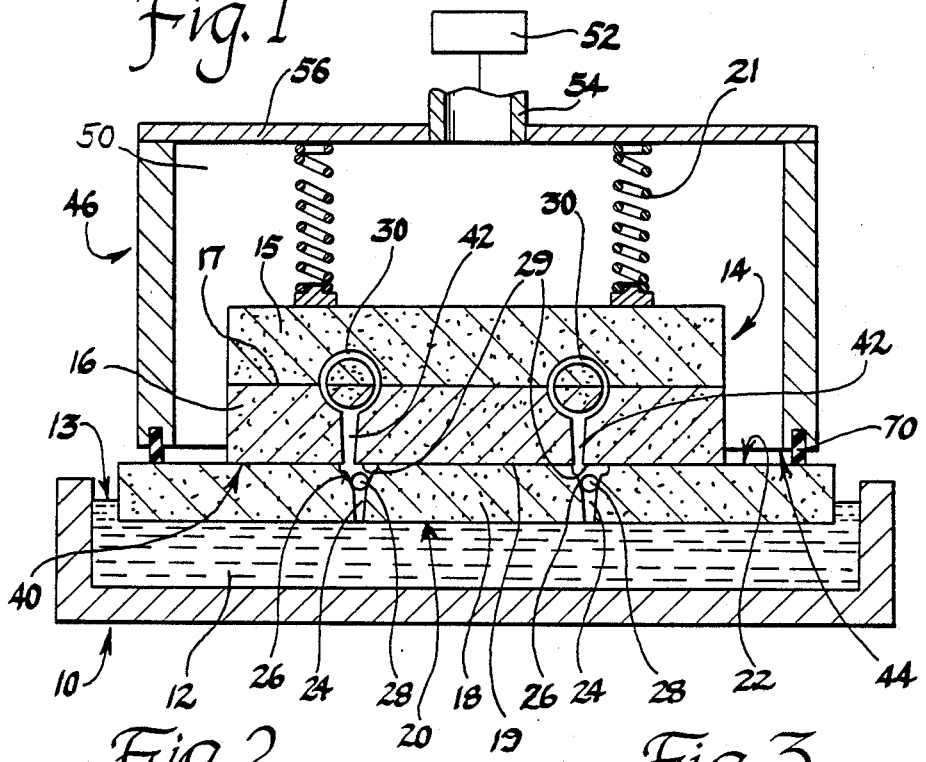
FIG. 1 is a sectioned side elevational view through one embodiment of a vacuum countergravity metal casting apparatus in accordance with the present invention.
Figure 2:
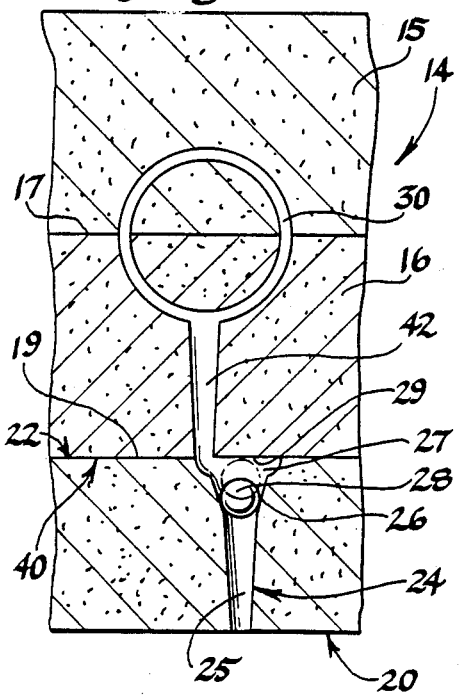
FIG. 2 is an enlarged view of a portion of FIG. 1.

In the drawings, like reference numerals are used for like parts or features in all of the Figures. Referring to FIGS. 1 and 2, a vacuum-assisted, countergravity casting apparatus in accordance with one embodiment of the invention is illustrated as including a container 10 of molten metal 12 to be countergravity cast into an expendable casting mold 14 that is disposed on a bottom drag slab or member 18 at a parting plane 19. The casting mold 14 comprises a porous, gas-permeable upper mold member or cope 15 engaged (e.g., glued or otherwise held in engagement) to a lower mold member or drag 16 at a mold parting plane 17. The mold drag 16 may be gas-permeable or impermeable.

The drag slab 18 includes a horizontal, flat bottom side 20 adapted for immersion in the molten metal pool 13 (formed by the molten metal 12 contained in the container 10), a horizontal, flat top side 22 and a plurality of laterally (horizontally) spaced apart, non-intersecting (substantially parallel) lower ingate passages 24 extending between the bottom and top sides 20,22. Each lower ingate passage 24 includes a lower, conical portion 25, an intermediate annular valve seat 26 and an upper, horizontally enlarged pocket or sump 27 opening to the top side 22 of the drag slab 18 adjacent the parting plane 19. Received on each valve seat 26 is a ball check valve 28. The ball check valves 28 are made of a material resistant to the destructive effects of the molten metal 12. Thus, for casting aluminum or gray cast irons, a carbon or chrome steel ball check valve is useful. For casting higher melting materials, such as nodular iron, a tungsten-coated carbon steel ball check valve 28 is effective.

Those skilled in the art will appreciate that the invention is not limited to use of ball check valves 28 and that other forms of valve means can be used to practice the invention.

As shown best in FIGS. 1 and 2, the gas permeable cope 15 and the drag 16 define a plurality of annular (or other shape) mold cavities 30 therebetween. The mold drag 16 includes a bottom side 40 engaged on the top side 22 of the drag slab 18 to define the parting plane 19 therebetween. Formed in the mold drag 16 between the bottom side 40 and each mold cavity 30 are upper ingate passages 42.

Each upper ingate passage 42 is axially offset relative to the underlying lower ingate passage 24 (i.e., vertical axes of the passages 24,42 are horizontally offset) and is registered or aligned in metal flow communication with the horizontally enlarged sump 27 of the underlying lower ingate passage 24 to receive the molten metal 12 therefrom. As a result of the relative axial offset between the upper ingate passage 42 and the lower ingate passage 24, a portion of the bottom 40 of the mold drag 16 forms a ceiling or stop surface 29 overlying each valve seat 26 and ball check valve 28 to limit maximum upward travel of each ball check valve 28 during filling of the mold cavities 30 with the molten metal 12. The distance between the conical valve seat 26 and the stop surface 29 may be selected to provide a desired amount of upward movement of the ball check valve 28 during mold filling to aid in control of the flow of the molten metal 12 into each mold cavity 30 as will be explained hereinbelow.

The mold cope 15 and the mold drag 16 may be made of resin-bonded sand in accordance with known mold practice wherein a mixture of sand or equivalent particles and bonding material is formed to shape and cured or hardened against a suitable pattern to form the desired mold cavities 30, ingate passages 42 and other features thereon. Similarly, the drag slab 18 may be made of resin-bonded sand in accordance with known mold practice. However, preferably, the drag slab 18 is formed of a high temperature ceramic material to permit reuse of the drag slab in the casting of successive casting molds 14. The use of a reuseable drag slab 18 carrying one or more expendable casting molds 14 permits use of less complex molds made from lesser quantities of mold materials and perchance cheaper materials which are not as thermally durable as those required when the casting mold itself is immersed in the molten metal.

The casting mold 14 is sealingly received in the mouth 44 of a vacuum housing 46 that defines a vacuum chamber 50 confronting the cope 15, FIG. 1 and held in place against the drag slab 18 by springs 21 such as described in copending U.S. patent application Ser. No. 211,020 filed June 24, 1988, of common assignee herewith. The vacuum chamber 50 is communicated to a vacuum source 52 (e.g., a vacuum pump) through a conduit 54 sealingly connected to the upper end wall 56 of the housing 46 so that the mold cavities 30 can be evacuated through the gas permeable cope 15 to draw the molten metal 12 through the lower ingate passages 24 and the upper ingate passages 42 when the drag slab 18 is immersed in the molten metal pool 13. The vacuum housing 46 and the casting mold 14 typically are sealed together by a sealing gasket 70 compressed between the mouth 44 and the drag slab 18 by suitable clamping means (not shown) holding the vacuum housing 46 and the casting mold 14 together.

In operation with the casting mold 14 and the vacuum housing 46 cooperatively assembled as shown in FIG. 1, the bottom drag slab or member 18 is lowered toward the molten metal pool 13 to immerse the bottom side 20 thereof in the molten metal pool 13 to position the lower ingate passages 24 in the molten metal pool 13 and the vacuum source 52 is then actuated to provide a reduced pressure (subambient pressure) in the vacuum chamber 50 and thus in the mold cavities 30 (through the gas permeable cope 15). The subambient pressure established in the mold cavities 30 is sufficient to draw the molten metal 12 upwardly through each lower ingate passage 24, past each ball check 28 (which is dislodged upwardly off its valve seat 26) and through each upper ingate passage 42 registered thereabove into each mold cavity 30 to fill the mold cavities 30 simultaneously with the molten metal 12. As the molten metal 12 is urged upwardly by evacuation of the mold cavities 30, the ball check valve 28 in each lower ingate passage 24 is raised off its valve seat 26 preferably until the ball check valve 28 abuts the overlying stop surface 29 of the mold drag 16 (upper position of the ball check valve 28 shown in phantom in FIG. 2) so as to controllably limit upward travel of each ball check valve 28.

The spacing between valve seat 26 and the associated stop surface 29, the size of the ball check valves 28 as well as the number, size and shape of the lower ingate passages 24 and the upper ingate passages 42 are selected to provide a desired molten metal flow rate to quickly fill the mold cavities 30 without premature solidification of the molten metal 12 therein and yet at the same time avoid erosion of the internal mold surfaces by the molten metal flowing into the mold 14. The sump 27 in each lower ingate passage 24 functions to provide a more or less even (substantially constant) molten metal flow rate to each mold cavity 30.

After the mold cavities 30 are filled with the molten metal 12 and before the molten metal 12 in the ingate passages 24,42 and the mold cavities 30 is solidified, the bottom drag slab 18 is moved upwardly to remove the bottom side 20 thereof from the molten metal pool 13. When the bottom side 20 is withdrawn from the molten metal pool 13 after mold filling, each ball check valve 28 is forced by the head (fluid pressure) of molten metal thereabove in the upper ingate passage 42 and the mold cavity 30 downwardly into sealing engagement on its valve seat 26 to prevent the molten metal 12 in the upper ingate passages 42 and the mold cavities 30 from draining downwardly out of the mold 14. However, the unsolidified molten metal in each lower ingate passage 24 drains back into the pool 13 as the drag slab 18 is withdrawn from the pool 13.

The metal-filled casting mold 14 is then separated from the vacuum housing 46 and the drag slab 18 and transferred to a de-molding area where the mold 14 and solidified metal castings (not shown) in the mold cavities 30 are separated. The drag slab 18 may be reused to cast another casting mold 14.

Figure 3:
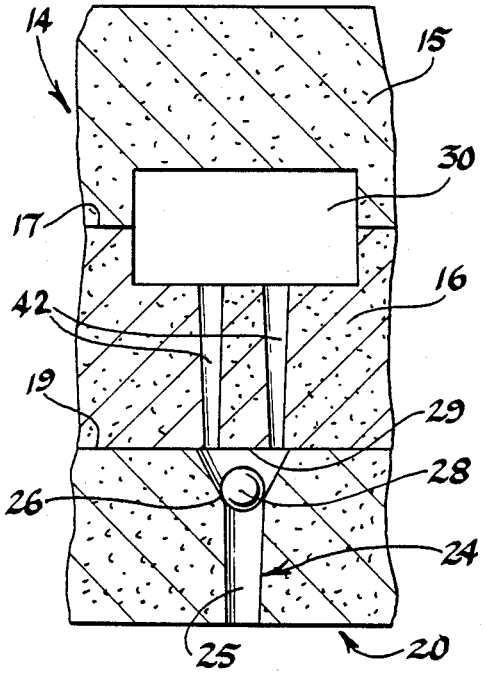
FIG. 3 is an enlarged view similar to FIG. 2 of an embodiment of the invention having a different arrangement of lower and upper ingate passages.

FIG. 3 illustrates another embodiment of the invention differing from the embodiment of FIGS. 1 and 2 in that the mold drag 16 includes a plurality of laterally (horizontally) spaced apart, upper ingate passages 42 defining a central stop surface 29 disposed on the underside of the drag 16 and overlying the valve seat 26 and the ball check valve 28 to limit its upward movement during mold filling. The upper ingate passages 42 are axially offset relative to the lower ingate passage 24 in the drag slab 18 to this end. The embodiment of FIG. 3 functions in a like manner as described hereinabove for the embodiment of FIGS. 1 and 2.

Those skilled in the art will appreciate that incorporation of the valve means (i.e., valve seat 26, ball check valve 28 and stop surface 29) between the mold drag 16 and the bottom drag slab 18 allows the bottom drag slab 18 to be withdrawn from the molten metal pool 13 after the mold cavities 30 are filled with the molten metal 12 and prior to solidification of the molten metal 12 in the lower and upper ingate passages 24,42 and the mold cavities 30. Thus, the bottom drag slab 18 needs to be immersed in the pool 13 only long enough to fill the mold cavities 30; e.g., typically, only about 2–3 seconds and need not remain immersed in the pool 13 until the molten metal 12 in ingate passages 24,42 and the mold cavities 30 is solidified. As a result, the invention provides a significant reduction in the overall casting cycle time. Furthermore, since the drag slab 18 is immersed in the pool 13 for much shorter times, resin-bonded sand of the drag slabs 18 suffers less thermal decomposition (gasification) from the heat of the pool 13. A reduction in the quantity of gas generated during mold filling results in a concomitant decrease in the number of casting defects attributable to gas entrapment in the molten metal 12 as it fills the mold cavities 30.

Moreover, positioning of the valve means adjacent the parting plane 19 greatly facilitates forming the valve seats 26 on the bottom drag slab 18 and the stop surfaces 29 on the mold drag 16 as well as assembly of the ball check valves 28 between the valve seats 26 and the stop surfaces 29. The valve seats 26, stop surfaces 29 and ball check valves 28 are directly accessible for inspection and repair, if necessary, before the mold drag 16 and bottom drag slab 18 are engaged together at the parting plane 19.

Although the casting apparatus has been illustrated hereinabove as including the casting mold 14 disposed on the bottom drag slab 18 at the parting plane 19 to form a three component casting apparatus (mold cope 15, mold drag 16 and bottom drag slab 18) with the valve means (i.e., valve seat 26, valve 28 and stop surface 29) disposed adjacent the parting plane 19, those skilled in the art will appreciate that the valve means may alternatively be positioned between the mold cope 15 and the mold drag 16 at the mold parting plane 17 to form a two component casting apparatus (i.e., an upper mold cope or member 15 and a bottom mold drag or member 16 without the drag slab 18) and that the bottom side 40 of the mold drag 16 would be immersed in the molten metal 12 to countergravity fill the mold cavities 30 (formed at least partially in the cope 15) with the molten metal 12 in the same manner as explained hereinabove for the three component casting apparatus.

While the invention has been described in terms of specific embodiments thereof, it is not intended to be limited thereto but rather only to the extent set forth hereafter in the claims which follow.

We claim:

1. A casting apparatus for use in the vacuum-induced, countergravity casting of molten metal, comprising:

(a) a drag member having a bottom side adapted for immersion in an underlying pool of molten metal and a top side, (b) a casting mold member on the top side of the drag member, said casting mold member having a bottom side engaged on the top side of the drag member to form a parting plane therebetween and a mold cavity formed at least in part therein, (c) ingate means disposed between the bottom side of the drag member and the mold cavity for supplying the molten metal to the mold cavity, and (d) valve means disposed in the ingate means adjacent the parting plane and including a valve member movable between the drag member and the casting mold member thereon to permit the molten metal to flow upwardly through the ingate means into the mold cavity when the bottom side of the bottom drag member is immersed in the pool with the mold cavity evacuated and to prevent back flow of the molten metal downwardly from the mold cavity through the ingate means when the bottom side of the bottom drag member is extracted from the pool after filling the mold cavity with the molten metal and before solidification of the molten metal in the mold cavity.

2. The apparatus of claim 1 wherein the valve means further includes a valve seat on said drag member and a stop surface on said casting mold member overlying the valve seat, said valve member being movable between said valve seat and said stop surface.

3. The apparatus of claim 2 wherein the valve seat is recessed in the top side of the drag member adjacent the parting plane.

4. The apparatus of claim 1 wherein the ingate means includes a lower ingate passage in said drag member and an upper ingate passage in said casting mold member thereon.

5. The apparatus of claim 4 wherein the lower ingate passage and the upper ingate passage are relatively axially offset to form a valve member stop surface on said casting mold member.

6. The apparatus of claim 2 wherein the valve member comprises a ball check valve.

7. The apparatus of claim 1 wherein the drag member is a bottom drag slab and said casting mold member is a drag portion of a casting mold.

8. An apparatus for the vacuum-assisted countergravity casting of molten metal, comprising:

(a) a drag slab having a bottom side for immersion in an underlying pool of molten metal, a top side and a slab ingate passage between the bottom side and the top side, (b) an expendable casting mold on the top side of the drag slab overlying the slab ingate passage, said casting mold including a bottom side supported on the top side of the drag slab to form a parting plane therebetween, a mold cavity therein and a mold ingate passage between the mold cavity and the bottom side of the casting mold and in flow communication with said slab ingate passage therebelow for receiving molten metal therefrom, and (c) valve means disposed in the slab ingate passage adjacent the parting plane and including a valve member movable between the drag slab and the casting mold to permit the molten metal to flow upwardly through the slab ingate passage and mold ingate passage into the mold cavity when the bottom side of the drag slab is immersed in the pool with the mold cavity evacuated and to prevent back flow of the molten metal downwardly from the mold cavity though the mold ingate passage when the bottom side of the drag slab is extracted from the pool after filling the mold cavity with the molten metal and before solidification of the molten metal in the mold cavity.

9. The apparatus of claim 8 wherein the casting mold includes a lower mold drag having a bottom side supported on the top side of the drag slab and an upper mold cope disposed on the mold drag, said valve member being movable between the drag slab and the mold drag.

10. The apparatus of claim 9 wherein the valve means further includes a valve seat on the drag slab and stop surface on the mold drag overlying the valve seat, said valve member being movable between said valve seat and said stop surface.

11. The apparatus of claim 10 wherein the mold ingate passage is axially offset with respect to the slab ingate passage to form said stop surface on said mold drag.

12. A method of vacuum countergravity casting of molten metal, comprising the steps of:

(a) relatively moving (1) a casting apparatus having a bottom drag member and a casting mold member disposed thereon and forming a parting plane therebetween, and (2) an underlying molten metal pool to immerse a bottom side of the bottom drag member in the pool, (b) evacuating a mold cavity formed at least in part in said casting mold member when the bottom side of the bottom drag member is immersed in the pool to draw the molten metal upwardly through ingate means disposed between the bottom side and the mold cavity, including moving a valve member disposed in the ingate means adjacent the parting plane between said bottom drag member and said casting mold member thereon in a valve open manner for supplying the molten metal to the mold cavity through the ingate means, and (c) withdrawing the bottom side of the bottom drag member from said pool after the mold cavity is filled with the molten metal and before the molten metal solidifies in the mold cavity, including moving the valve member in the ingate means between said bottom drag member and said casting mold member thereon in a valve closed manner for preventing back flow of the molten metal downwardly from the mold cavity through the ingate means.

13. The method of claim 12 wherein in step (b), the valve member moves from a valve seat on the bottom drag member upwardly into contact with a stop surface on said casting mold member.

14. The method of claim 13 wherein in step (c), the valve member moves downwardly from the stop surface onto the valve seat.

15. The method of claim 12 including in step (c), draining the molten metal disposed below the valve member in the ingate means into the underlying molten metal pool.

* * * * *